US005268881A

United States Patent [19]

Damm

[11] Patent Number: 5,268,881

[45] Date of Patent: Dec. 7, 1993

[54] COMPENSATOR FOR A MECHANICAL PENDULUM CLOCK

[75] Inventor: Eric Damm, Stadtallendorf, Fed. Rep. of Germany

[73] Assignee: Harry Wolff, Grebenhain, Fed. Rep. of Germany; a part interest

[21] Appl. No.: 853,385

[22] Filed: Mar. 18, 1992

[30] Foreign Application Priority Data

Mar. 19, 1991 [DE] Fed. Rep. of Germany ..... 4108935

[51] Int. Cl.[5] ..... G04B 15/00

[52] U.S. Cl. ..... 368/134; 368/137

[58] Field of Search ..... 368/134–138, 368/165–167

[56] References Cited

U.S. PATENT DOCUMENTS 4,106,280 8/1978 Schulz et al. ..... 368/85

FOREIGN PATENT DOCUMENTS 452433 11/1927 Fed. Rep. of Germany .
2905173 8/1980 Fed. Rep. of Germany .
2946506 5/1981 Fed. Rep. of Germany .
3110714 10/1982 Fed. Rep. of Germany .
1254583 1/1960 France .
1388783 1/1965 France .
1439715 4/1966 France .
3590573 7/1971 France .
2305768 12/1976 France .
405100 4/1974 U.S.S.R. .

OTHER PUBLICATIONS

Honda Kazuhiro et al., "Clock Antenna", Patent Abstracts of Japan, vol. 012085, Mar. 17, 1988.

*Primary Examiner*—Bernard Roskoski
*Attorney, Agent, or Firm*—Wegner, Cantor, Mueller & Player

[57] ABSTRACT

A compensator for a mechanical pendulum clock has on the rear side of a pendulum bob a center of gravity adjusting device, which is actuated by an electric motor. An electronic controller, which is designed as a comparator and which works as a function of the difference between the signals of a pendulum frequency generator and a clock generator designed as quartz reference oscillator, serves to drive the electric motor.

12 Claims, 1 Drawing Sheet

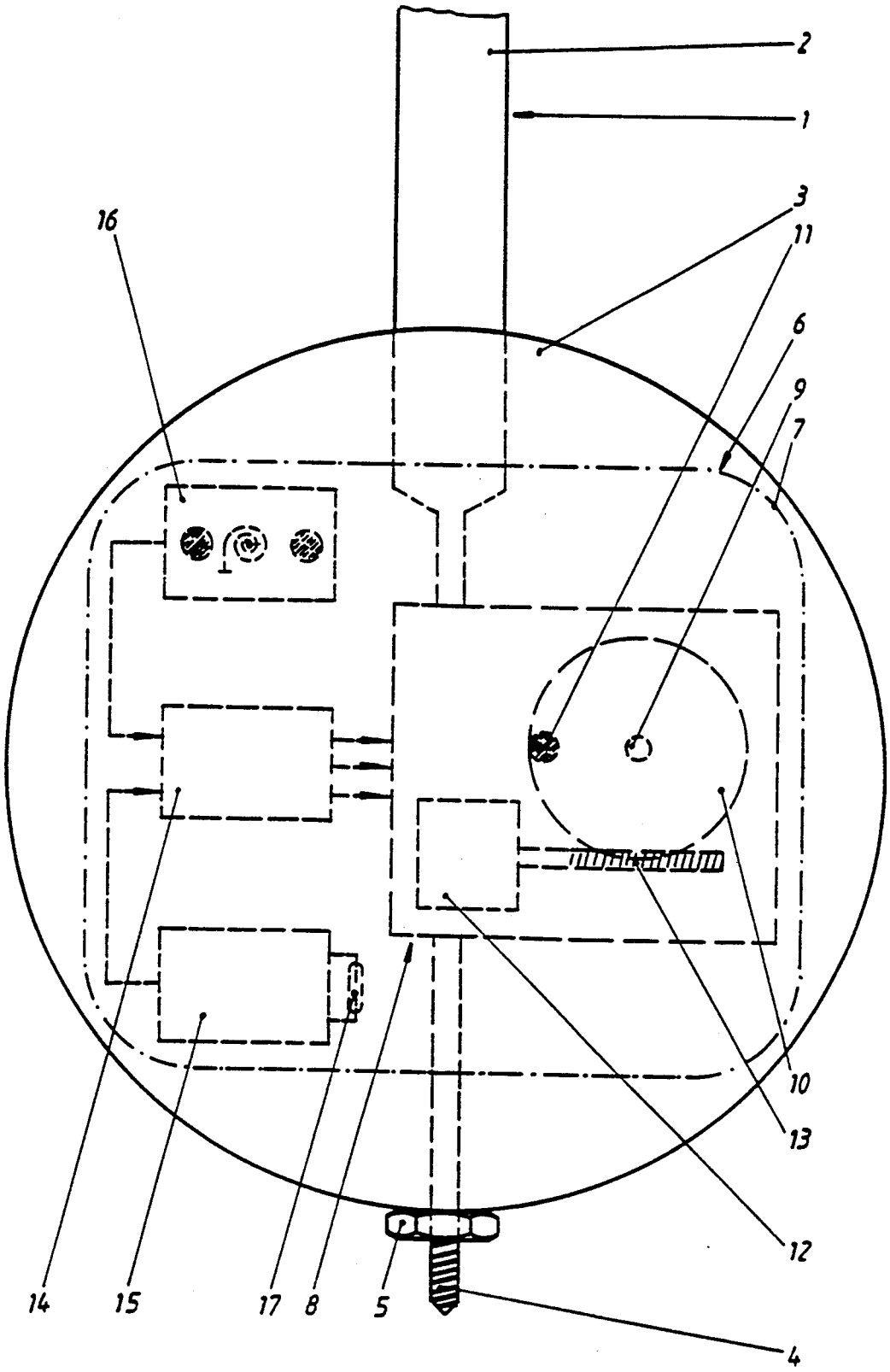
2
1
3
11
16
6
9
7
10
13
12
14
15
17
8
5
4

COMPENSATOR FOR A MECHANICAL PENDULUM CLOCK

BACKGROUND OF THE INVENTION

This invention relates to a compensator for a mechanical pendulum clock to compensate for disturbance variables that affect the accuracy of the pendulum clock.

Mechanical pendulum clocks have been built since about 1650. At the beginning of this century they reached its technological high point Accuracies of better than 1/100 second per day were attained. This required complicated compensators, which especially balance the effect of the temperature and the air pressure on the accuracy of the clock. The compensating pendulum, wherein to compensate for the temperature several rods having different temperature coefficients are arranged in such a manner that the center of gravity of the pendulum does not change with thermal expansions is known.

Despite inexpensive quartz clocks that work with very high accuracy, mechanical pendulum clocks have again become popular for the past few years. Both restored antique clocks and also reproductions thereof are popular. Unfortunately, the accuracy of such clocks is usually unsatisfactory In addition to the inaccuracies existing from the beginning due to fluctuations in temperature and air pressure and simple escapement systems, over the course of time inaccuracies arise due to the wear of the train of the clockwork and the gumming of the oil in the clock. Deviations of up to 10 seconds per day are normal, which today are found to be highly disturbing. Nevertheless, one does not often want to do without such pendulum clocks, frequently merely on account of their lovely stroke.

SUMMARY OF THE INVENTION

The problem on which the present invention is based is to design a compensator for a mechanical pendulum clock that enables the pendulum clock to reach an accuracy comparable to quartz clocks, and a subsequent improvement of the accuracy of existing clocks is possible with a minimum of effort and without any visible change of the pendulum clock.

This problem is solved by the invention in that the compensator includes a motor-driven center of gravity adjusting device to be attached to the pendulum and an electronic controller forming a comparator, which is connected on the input side to an electronic clock generator and a pendulum frequency generator, in order to control the center of gravity adjusting device.

With such a compensator acting as an electronic clock generator, the same high accuracy can be attained with mechanical pendulum clocks even with fluctuating disturbance variables as with a quartz clock. Therefore, thanks to the invention, mechanical pendulum clocks can also be used, when high accuracy is important. Since the compensator of the invention must adjust only the center of gravity of the pendulum, it can be provided very easily in the field without any modifications to the pendulum clock.

The compensator of the invention can be constructed from generally standard components in electronics, when the pendulum frequency generator is a resonance oscillator, which is attached to the pendulum, and the clock generator is a quartz reference oscillator.

Mechanical pendulum clocks can attain the accuracy of atomic clocks, if, according to another embodiment of the invention, the clock generator exhibits a radio clock.

The radio clock does not require a separate aerial, if, according to another advantageous embodiment of the invention, the clock generator exhibiting the radio clock is attached to the pendulum bob, and the pendulum rod forms the aerial of the radio clock.

The subsequent retrofitting of existing pendulum clocks through installation of the compensator according to the invention can be done in an especially simple and inexpensive manner, if all of its components are designed so as to be attached to the pendulum bob.

Even a layman can mount with the skill of a craftsman the compensator according to the invention, if all of its components are disposed in a single housing that can be attached to the pendulum bob.

Another advantageous embodiment of the invention lies in the fact that all of the components of the compensator can be encapsulated by the pendulum bob within the pendulum bob. Thus it is possible with existing pendulum clocks to replace the pendulum for a pendulum according to the invention, in order to attain an accuracy for the pendulum clock analogous to that of the quartz clock.

The center of gravity adjusting device can b®designed in very different ways. It must have a weight, whose distance from the pendulum axis is adjustable. The center of gravity adjusting device is designed especially simple if it is a rotatable disk, which can be rotated by an electric motor, with its center of gravity located outside its point of rotation. Such a disk can bear a weight, for example, at one point. However, it is also possible to hollow out a sector on it, so that its center of gravity changes with the rotation of the disk.

The disk could be adjusted in an analog manner, so that a stepless change of the center of gravity and thus a stepless adjustment of the velocity of the pendulum clock is attained. In practical operation it has been demonstrated to be adequate if the controller of the electric motor of the disk is designed to move the disk out of a central position into an upper and a lower center of gravity position. Such an embodiment has the advantage that only rarely is a correcting movement necessary, so that the energy consumption for the adjustment is low and the compensator according to the invention can function a very long time with a small battery.

The clock generator has to generate the theoretically necessary pendulum frequency Since this is often not known, the electronics in the quartz reference oscillator could be designed in such a manner that in an initialization process the duration of the actual pendulum swing is automatically measured and is used as the reference variable for a clock generator designed as a programmable divider. However, the automatically acquired value will usually not be accurate enough The fine adjustment of the pendulum clock is then achieved in a simple manner through incremental adjustment of the dividend of the divider. Thus, stopping the pendulum can be avoided, if, according to another embodiment of the invention, the clock generator is designed as a programmable divider, and a Hall-effect switch, which can be actuated by a magnet, is provided to set said divider.

DETAILED DESCRIPTION OF THE DRAWING

The invention allows a number of embodiments. To further illustrate its basic principle, the sole figure of the drawing is a schematic view of a pendulum with the compensator according to the invention, which is described below.

DETAILED DESCRIPTION OF THE INVENTION

The drawing shows a pendulum 1, comprising a pendulum rod 2 and a conventional pendulum bob 3. The bottom end of the pendulum rod 2 is provided with a thread 4, so that the height of the pendulum bob 3 can be adjusted by hand with an actuating screw 5, in order to regulate the speed of the pendulum clock.

A compensator 6, designed according to the invention, is mounted on the rear side of the pendulum bob 3. Said compensator has in an indicated housing 7 a center of gravity adjusting device 8, which has a disk 10 that can be rotated around an axis of rotation 9 and carries a weight 11. An electric motor 12 can rotate by means of a spindle 13 the disk 10, which is designed as a worm wheel for this purpose.

An electronic controller 14, which is designed as a comparator and compares the signals of an electronic clock generator 15, designed as a quartz reference oscillator, and a pendulum frequency generator 16, serves to drive the electric motor 12. If there is difference between the reference oscillation and the pendulum oscillation, the electric motor 12 is driven in such a manner that the weight 11 is moved up or down by rotating the disk 10 and, thus, the pendulum swing is increased or decreased.

The pendulum frequency generator 16 generates an electric pulse with every complete swing of the pendulum. This can be realized in various ways. For example, as in the case of the pocket watch, a mechanical resonance system with spiral spring and oscillating weight can be provided. If the natural oscillation of this system is in the vicinity of the pendulum frequency, the result is sufficient oscillation amplitude to actuate a contact. Thus, the pendulum frequency generator 16 delivers the "actual frequency".

The "desired" is delivered by the clock generator 15. The frequency of this pulse train corresponds to the pendulum oscillation computed from the train of the pendulum clockwork. This oscillation of the clock generator 15 is crystal stabilized. It can be generated, for example, with a programmable divider. To enable a fine adjustment of the clock generator 15 without stopping the pendulum 1, a Hall-effect switch 17 to be actuated with a magnet is provided.

The controller 14 is substantially an incrementer/-decrementer. If the incoming pulse trains agree, this counter is always at zero (the clock is running accurately). If the pulse trains deviate, however, in time from one another, the error accumulates and the count increases or decreases.

I claim:

1. A compensator for a mechanical pendulum clock to compensate for disturbance variables that affect the accuracy of the pendulum clock, said compensator comprising an electronic clock generator for generating a reference signal, a pendulum frequency generator for generating a signal representative of the frequency of a pendulum, an electronic controller forming a comparator which is connected on the said side to said electronic clock generator and said pendulum frequency generator to receive input signals therefrom, said comparator producing an output signal, and a motor-driven center of gravity adjusting means for adjusting the center of gravity of said compensator actuated by said electronic controller responsive to said output signal, said compensator being adapted to be attached to the pendulum and.

2. Compensator, as claimed in claim 1, wherein the pendulum frequency generator is a resonance oscillator, which is attached to the pendulum, and the clock generator is a quartz reference oscillator.

3. Compensator, as claimed in claim 1, wherein the clock generator comprises a radio clock.

4. Compensator, as claimed in claim 3, wherein the clock generator is attached to the pendulum bob, and the pendulum rod forms the aerial of the radio clock.

5. Compensator, as claimed in claim 1, wherein all of its components are designed so as to be attached to the pendulum bob.

6. Compensator, as claimed in claim 1, wherein all of its components are disposed in a single housing that can be attached to the pendulum bob.

7. Compensator, as claimed in claim 1, wherein all of its components are encapsulated by the pendulum bob within the pendulum bob.

8. Compensator, as claimed in claim 1, wherein the center of gravity adjusting means is a rotatable disk, which can be rotated by an electric motor, with its center of gravity located outside its axis of rotation.

9. Compensator, as claimed in claim 8, wherein the controller of the electric motor of the disk is designed to move the disk out of a central position into an upper and lower center of gravity position.

10. Compensator, as claimed in claim 1, wherein the clock generator is designed as a programmable divider, and a Hall-effect switch, which can be actuated by a magnet, is provided to set said divider.

11. In combination, a mechanical pendulum clock and a compensator to compensate for disturbance variables that affect the accuracy of the pendulum clock, wherein the compensator comprises an electronic clock generator for generating a reference signal, a pendulum frequency generator for generating a signal representative of the frequency of the pendulum, an electronic controller forming a comparator which is connected on the input side to said electronic clock generator and said pendulum frequency generator to receive said signals therefrom, said comparator producing an output signal, and a motor-driven center of gravity adjusting means for adjusting the center of gravity of said compensator actuated by said electronic controller responsive to said output signal, said compensator being attached to the pendulum.

12. In combination, a pendulum for a mechanical pendulum clock and a compensator to compensate for disturbance variables that affect the accuracy of the pendulum clock, wherein the compensator comprises an electronic clock generator for generating a reference signal, a pendulum frequency generator for generating a signal representative of the frequency of the pendulum, an electronic controller forming a comparator which is connected on the input side to said electronic clock generator and said pendulum frequency generator to receive said signals therefrom, said comparator producing an output signal, and a motor-driven center of gravity adjusting means for adjusting the center of gravity of said compensator actuated by said electronic controller responsive to said output signal, said compensator being attached to the pendulum.

* * * * *